US011668068B2

(12) United States Patent
Albers

(10) Patent No.: US 11,668,068 B2
(45) Date of Patent: Jun. 6, 2023

(54) BUCKET FOR UNDERGROUND LOADING MACHINE

(71) Applicant: Caterpillar Underground Mining Pty. Ltd., South Burnie (AU)

(72) Inventor: Riley A. Albers, Sugar Grove, IL (US)

(73) Assignee: Caterpillar Underground Mining Pty. Ltd., Tasmania (AU)

( * ) Notice: Subject to any disclaimer, the term of this patent is extended or adjusted under 35 U.S.C. 154(b) by 353 days.

(21) Appl. No.: 16/810,268

(22) Filed: Mar. 5, 2020

(65) Prior Publication Data

US 2021/0277623 A1 Sep. 9, 2021

(51) Int. Cl.
*E02F 3/40* (2006.01)
*E02F 9/28* (2006.01)
*E02F 3/815* (2006.01)

(52) U.S. Cl.
CPC ..... *E02F 3/401* (2013.01); *E02F 3/8152* (2013.01); *E02F 9/2883* (2013.01)

(58) Field of Classification Search
None
See application file for complete search history.

(56) References Cited

U.S. PATENT DOCUMENTS

| | | | | |
|---|---|---|---|---|
| 4,523,397 | A | 6/1985 | Lucas | |
| 7,266,914 | B2 | 9/2007 | Grant | |
| 7,429,158 | B2 | 9/2008 | McFarland | |
| 10,246,849 | B2 | 4/2019 | Marek et al. | |
| 2003/0066215 | A1 | 4/2003 | Grant | |
| 2006/0182590 | A1* | 8/2006 | McFarland | E02F 3/401 414/685 |
| 2016/0362873 | A1* | 12/2016 | Campomanes | E02F 9/2883 |
| 2018/0087236 | A1 | 3/2018 | Marek et al. | |
| 2018/0127952 | A1 | 5/2018 | Magliulo et al. | |

FOREIGN PATENT DOCUMENTS

| | | | |
|---|---|---|---|
| AU | 2017228636 | A1 | 4/2018 |
| CN | 107165206 | A | 9/2017 |
| CN | 109098219 | A | 12/2018 |
| CN | 109983183 | A | 7/2019 |

(Continued)

OTHER PUBLICATIONS

PEBJ0030-02 "CAT © Ground Engaging Tools for Surface Extraction Machines", (Author Unknown), copyright 2015, last modified Apr. 29, 2016, demonstrated to be available for download as early as Dec. 1, 2017 via Internet Archive Wayback Machine (Year: 2017).*

(Continued)

*Primary Examiner* — Todd Melton
*Assistant Examiner* — Jason R Roberson
(74) *Attorney, Agent, or Firm* — Leydig, Voit & Mayer, Ltd.

(57) ABSTRACT

A bucket for an underground loading machine includes an opened bucket front and a concaved bucket back. To provide abrasive wear resistance, the bucket includes a paddle plate joined to the bucket underside of the bucket floor. The paddle plate can have a trumpet-shape tapering from flared forward edge to a plate tail disposed toward the concaved bucket back. The bucket may be configured as a wedge bottomed bucket and include a plurality of spacer wedges disposed between and spacing apart the bucket underside and the paddle plate.

21 Claims, 9 Drawing Sheets

(56) References Cited

FOREIGN PATENT DOCUMENTS

| | | | |
|---|---|---|---|
| EP | 3604683 | A1 | 2/2020 |
| GB | 1177839 | A | 1/1970 |

OTHER PUBLICATIONS

Caterpillar Inc., "988K XE Wheel Loader," product brochure, 36 pp. (2017).
Komatsu Mining Corp., "Joy 22HD Hybrid Loader—Underground Hard Rock Mining," product brochure downloaded from the Internet at https://mining.komatsu/product-details/joy-22hd on Nov. 4, 2019, , 4 pp.
Komatsu Mining Corp., "Wheel Loader WA900-8," product brochure, 7 pp. (2019).
Canadian Examination Report for Int'l. Patent Appln. No. 3169778, dated Mar. 9, 2023 (6 pgs).
CAT® Ground Engaging Tools for Surface Extraction Machines [retrieved from internet on Feb. 23, 2023] <URL: https://wheelercat.com/wp-content/uploads/2015/07/GET-Surface-Extraction-Machines.pdf> published on Dec. 1, 2017 as per Wayback Machine Whole Document.
Australian Examination Report for Patent Appln. No. 2021229907, dated Feb. 23, 2023 (3 pgs).

* cited by examiner

BUCKET FOR UNDERGROUND LOADING MACHINE

TECHNICAL FIELD

This patent disclosure relates generally to a bucket for a loading machine to scoop, haul, and dump material and, more particularly, to a bucket designed for a loading machine operating underground.

BACKGROUND

Wheel loaders and track loaders are machines used to dig, move, and dump material at different locations about a worksite. Such loading machines typically include a bucket attached to the distal end of a lift implement, which may be linkage configured to lift and tilt the bucket. The lift implement can demonstrate a substantial range of movement with respect to the loading machine to dig material from the ground and to lift and dump the material into a truck. A particular class of loading machines, however, are purposefully designed to work in underground mines where space is confined by low clearances and narrow passages. Underground operation is also considered relatively heavy duty because the material of interest is often hard, blasted rock, mining ores, and other hard, dense materials. Underground loading machines are therefore designed to be more compact and to conduct particular maneuvers to increase their effectiveness despite the operative space constraints and harsh conditions.

U.S. Pat. No. 10,246,849 ("the '849 patent") describes a bucket designed specifically for an underground loading machine to address the imposed space constraints and conditions. The '849 patent describes that the bucket may be tilted from a loading or digging position in which the bucket is oriented to penetrate into a pile of material to a curled or racked position in which the bucket and the associated loading machine can haul the material out of the mine without having to raise the lift implement. The loading machine is thus able to maintain a low profile even when hauling material underground. The '849 patent recognizes that utilizing the bucket in the foregoing manner may impart asymmetrical or uneven forces across the lateral length of the roof or upper surface of the bucket that could cause damage or premature wear. The '849 patent therefore proposes to add a torque tube across the lateral length of the bucket roof to reinforce the bucket roof against such forces. The present disclosure in contrast is directed to strengthening and reinforcing the lower floor of the bucket that is intended for similar underground applications.

SUMMARY

The disclosure describes, in one aspect, a bucket for an underground loading machine assembled from a bucket shell assembly including an opened bucket front and a concaved bucket back delineating a bucket depth along a bucket centerline. The bucket shell assembly can also include a center shell, a first outer shell flanking the center shell to a first lateral side, and a second outer shell flanking the center shell to a second lateral side wherein the center shell is forwardly offset with respect to the first and second side shells. The bucket shell assembly can further include a first sidewall joined to the first outer shell and a second sidewall joined to the second outer shell to define a lateral dimension of the bucket. A paddle plate can be joined to a bucket underside and can have a trumpet-shape that tapers from a flared forward edge extending the lateral dimension of the bucket to a plate tail disposed rearward toward the concaved bucket back. First and second backstay can extend rearwardly between plate tail and the concaved bucket back and can be associated with backstay side plates to provide enclosed space between the paddle plate and concaved bucket back.

In another aspect, the disclosure describes a bucket for an underground loading machine that includes a bucket shell assembly having an opened bucket front and a concaved bucket back. The bucket shell assembly further includes a bucket floor and a bucket roof with the concaved bucket back interconnecting the bucket floor and bucket roof. To strengthen the bucket floor, a paddle plate can be joined to a bucket underside of the bucket floor and can be spaced therefrom to provide a separation gap. The bucket shell further includes a center shell, a first outer shell flanking the center shell to a first lateral side, and a second outer shell flanking the center shell to a second lateral side. To prevent collapse of the separation gap, a plurality of spacer wedges that can have inclined first and second surfaces can be disposed between and adjacent to the bucket underside and the paddle plate. The spacer wedges can generally overlap the weld seams between the center shell and the first and second outer shells of bucket shell assembly.

In yet another aspect, the disclosure describes a bucket shell assembly including an opened bucket front, a concaved bucket back, and a bucket floor and bucket roof extending between the opened bucket front and the concaved bucket back. The bucket shell further includes a center shell, a first outer shell flanking the center shell to a first lateral side, and a second outer shell flanking the center shell to a second lateral side. The center shell can be forwardly offset with respect to the first and second side shells. Joined to the bucket underside can be a paddle plate having a trumpet-shape that tapers from a flared front edge to narrower a plate tail disposed rearward toward the concaved bucket back. Extending at a rearward angle between concaved bucket back and the plate tail can be a first backstay and second backstay, each associated with a backstay side plate to provide an enclosed space between the paddle plate and the concaved bucket back. A plurality of spacer wedges can be located between and spacing apart the bucket underside and the paddle plate to support the relative spacing of the bucket underside and the paddle plate.

DETAILED DESCRIPTION

Figure 1:
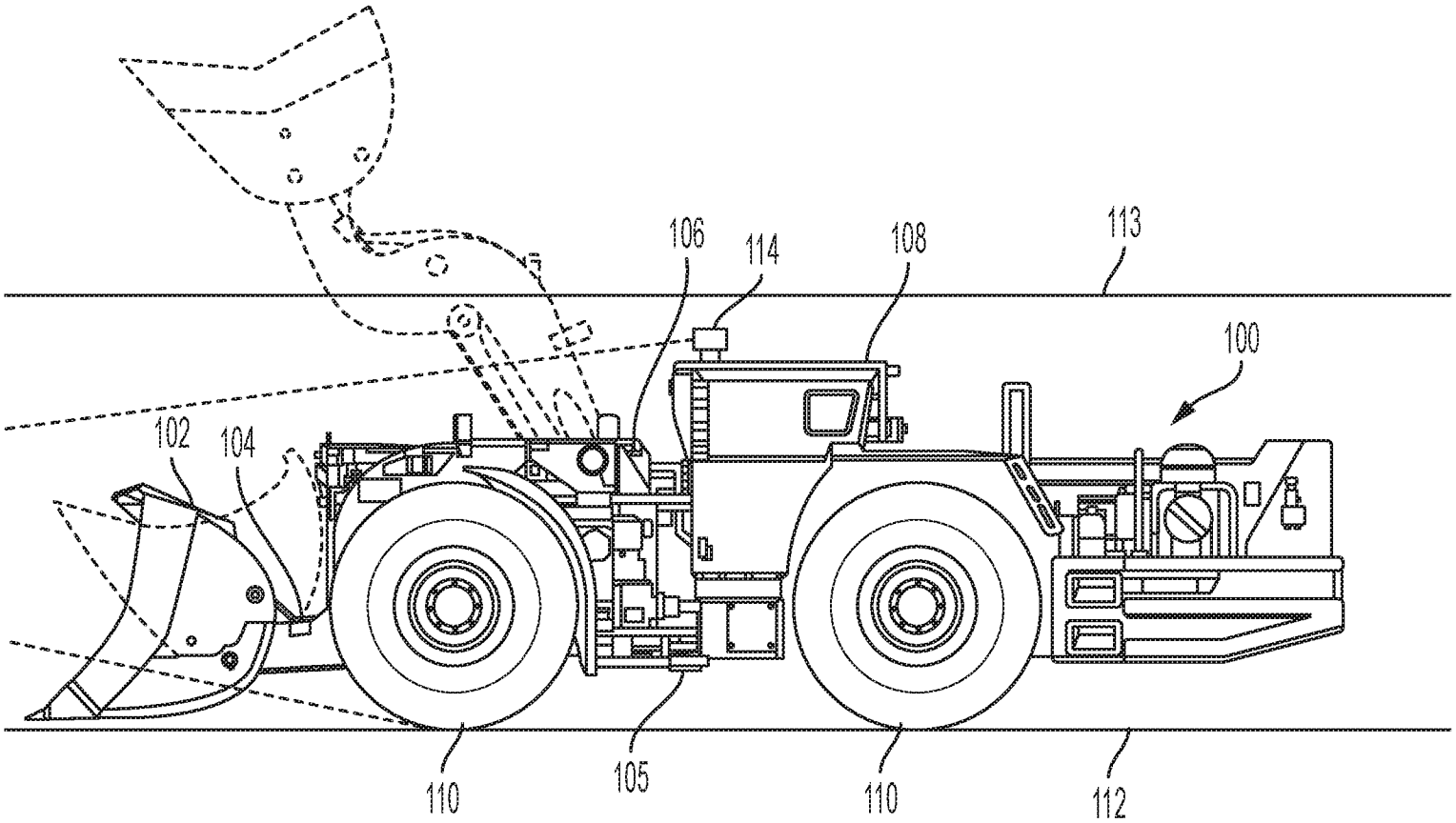
FIG. 1 is a side elevational view of a machine, specifically and wheel loader, designed for underground operation having a bucket coupled to a lift implement and illustrating various maneuvers and motions the lift implement and bucket can conduct.
Figure 2:
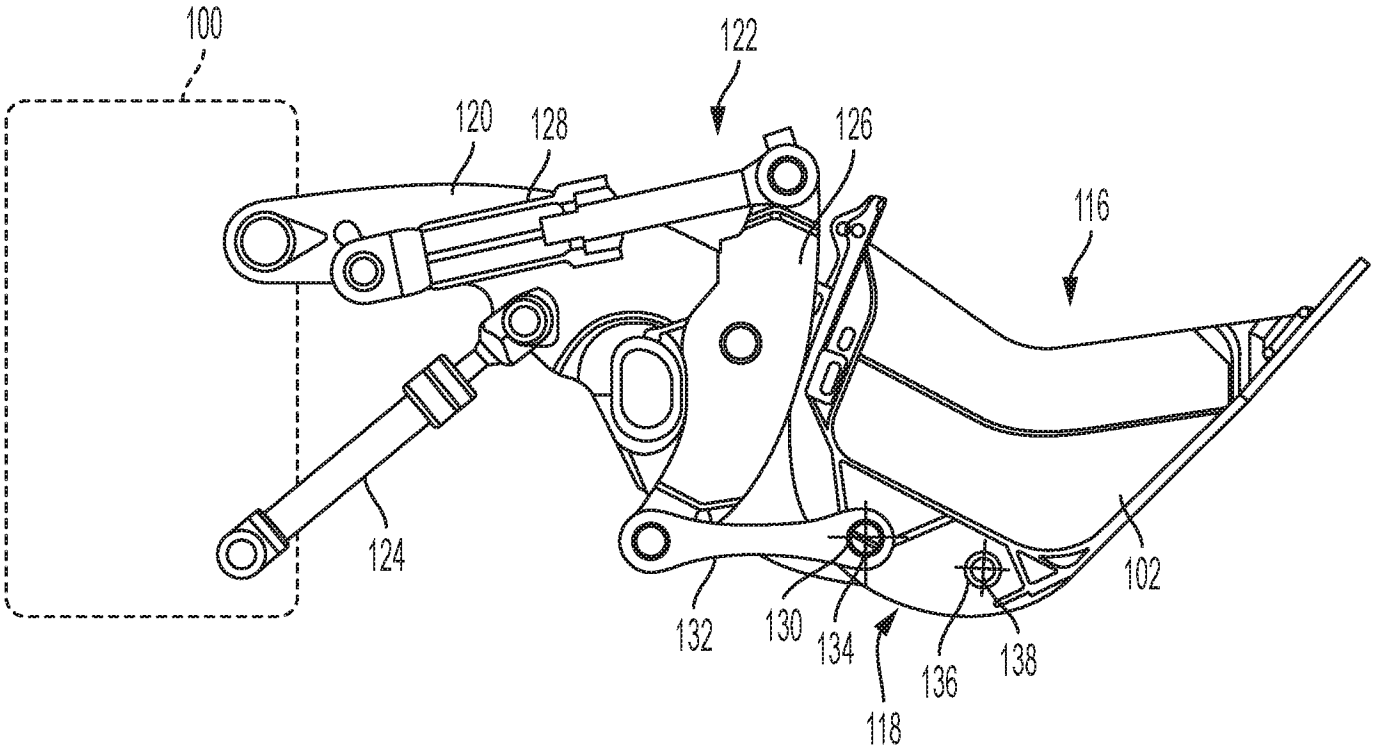
FIG. 2 is a side elevational view of the bucket and lift implement of FIG. 1 in a curled or racked position showing the coupling connection between the lift implement and the back of the bucket.

Now referring to the drawings, wherein whenever possible like reference numbers will refer to like elements, there is illustrated in FIGS. 1 and 2 a loading machine 100 configured for an underground operation such as in an underground mine to dig, haul, and dump material such as blasted rock, ore, and overburden. The loading machine 100 in the illustrated embodiment is an underground wheel loader, though in other embodiments the loading machine may be underground track loader or other type of loading machine intended to operate underground or in other locations having constrained spaces. Furthermore, while embodiments of the disclosure are described with respect to underground loading machines, aspects of the disclosure may be applicable to buckets used in application above ground. The loading machine 100 can include a bucket 102 operatively coupled to the distal end of a lift implement 104 to raise, lower, and tilt the bucket for various tasks such as digging or penetrating into the material, hauling the material, and dumping the material at another location. The lift implement 104 can be operatively attached to a machine frame 106 of the loading machine 100. Because of the space constraints underground, the machine frame can be purposefully designed to have a low profile with a reduced height. To accommodate an operator and the controls for operating the loading machine 100, a squat, low profile operator cab 108 can be supported on the machine frame 106, while to engage the ground, the machine frame 106 can be supported on a plurality of traction devices 110 such as wheels or, in other embodiments, continuous tracks. The low profile allows the loading machine 100 to operate within a low clearance location such as an underground mine with limited vertical distance between the ground 112 and the ceiling 113.

Because the loading machine 100 may need to dump the material into the bed of a hauling truck, the lift implement 104 can be raised (indicated in dashed lines) so that the bucket 102 is located above the machine frame 106. However, as indicated by the lines representing the ground 112 and ceiling 113, raising the lift implement 104 when underground or in another constrained location will collide the bucket 102 with the ceiling. Accordingly, the bucket 102 is coupled in a manner to tilt with respect to the lift implement 104 between a loading or digging orientation as shown and a racked orientation (indicated in dashed lines) in which the bucket 102 is able to hold and carry material while maintaining the low profile of the loading machine 100 and without striking the ceiling 113. In the racked orientation, the lift implement 104 remains lowered and the bucket 102 remains proximate the ground 112 but is oriented so that the material-receiving volume of the bucket is directed toward the ceiling 113.

The orientations at which the bucket 102 is located with respect to the rest of the loading machine 100 may be further constrained by underground operation. For example, the loading machine 100 may be equipped with a LIDAR system 114 located above the operator cab 108 that requires a line of sight (indicated in dashed lines) that must clear above the bucket 102 when in the racked orientation. Further, the bucket 102 may be filled with material rising above the bucket that could protrude into the line of sight from the LIDAR system 114. Accordingly, in the racked orientation, its desired to maintain the bucket 102 close to the ground 112. However, when the bucket 102 is tilted into the racked position, the backside of the bucket that rotates downward should still be capable of clearing the ground 112 in front of the traction devices 110 (as indicated in dashed lines). In various embodiments, the loading machine may be an articulated machine in which the frame 106 is joined between front and rear portions at a pivot joint 105 that allows the machine to make sharp turns as may be necessary in underground operations. It will be appreciated that the farther forward the bucket 102 is positioned with respect to the rest of the frame 106, the turn radius becomes larger because the overall length of the machine is increased. To address the foregoing constraints, the bucket 102 is desirably positioned in close proximity adjacent to the front of the loading machine 100 when in the racked orientation and is vertically disposed between the line of sight from the LIDAR system 114 while providing tilting clearance for the bucket 102 above the ground 112.

Referring to FIG. 2, the bucket 102 may have an opened bucket front 116 to receive the material and a concaved bucket back 118 to contain the material therein and to releasably couple to the lift implement 104 such that different buckets may be used on the same loading machine 100. The lift implement 104 can be a mechanical linkage including a plurality of rigid links connected to each other by pivotal joints to enable the linkage to move through different positions. To provide power to raise and lower the lift implement 104, the lift implement can include various hydraulic actuators and can be operatively associated with a hydraulic system including a hydraulic pump to supply pressurized hydraulic fluid. The lift implement 104 can include a lift arm 120 that pivotally connects to the loading machine 100 and that is operatively coupled to the bucket 102 through a tilt assembly 122. To raise and lower the lift implement 104, the lift arm 120 is connected to one end of a lift actuator 124 such as a hydraulic cylinder whose other end is also connected to the loading machine 100. Accordingly, the lift actuator 124 is braced between the lift arm 120 and the loading machine 100 such that extending and retracting the lift actuator 124 will raise and lower the lift arm 120 with respect to the loading machine 100.

The tilt assembly 122 includes a tilt lever 126 that is pivotally connected at its mid-body to the distal end of the lift arm 120. An upper end of the tilt lever 126 is connected to a tilt actuator 128 such as a hydraulic cylinder that is also connected to the loading machine 100. The lower end of the tilt lever 126 is pivotally connected to an upper coupling connector 130 on the concaved bucket back 118 of the bucket 102 through a connector link 132. The upper coupling connector 130, which may be a pin joint that forms a single axis journal or a revolute joint, defines an upper pivot axis 134 that extends laterally across the length of the bucket 102. The concaved bucket back 118 of the bucket 102 is also directly connected to the lift arm 120 at a lower coupling connector 136, which may also be a pin joint forming a single axis journal or revolute joint that defines a lower pin axis 138 that also extends laterally across the length of the bucket 102. Whereas actuating the lift actuator 124 raises and lowers the lift implement 104, actuating the tilt actuator 128 articulates the tilt lever 126 to tilt or revolve the bucket 102 about the lower pin axis 138. Thus, the bucket 102 can tilt or move between the racked or hauling position shown in FIG. 2 and the digging position shown in FIG. 1. To accommodate these connections while maintaining the compact design of the loading machine 100, however, a portion of the lift arm 120 and the tilt assembly 122 must protrude into and be accommodated in the profile of the concaved bucket back 118 of the bucket 102. In addition, although one lift arm 120 is shown in FIG. 2, often two parallel lift arms will be included in the lift implement 104 that must be attached to the concaved bucket back 118 of the bucket 102.

Figure 3:
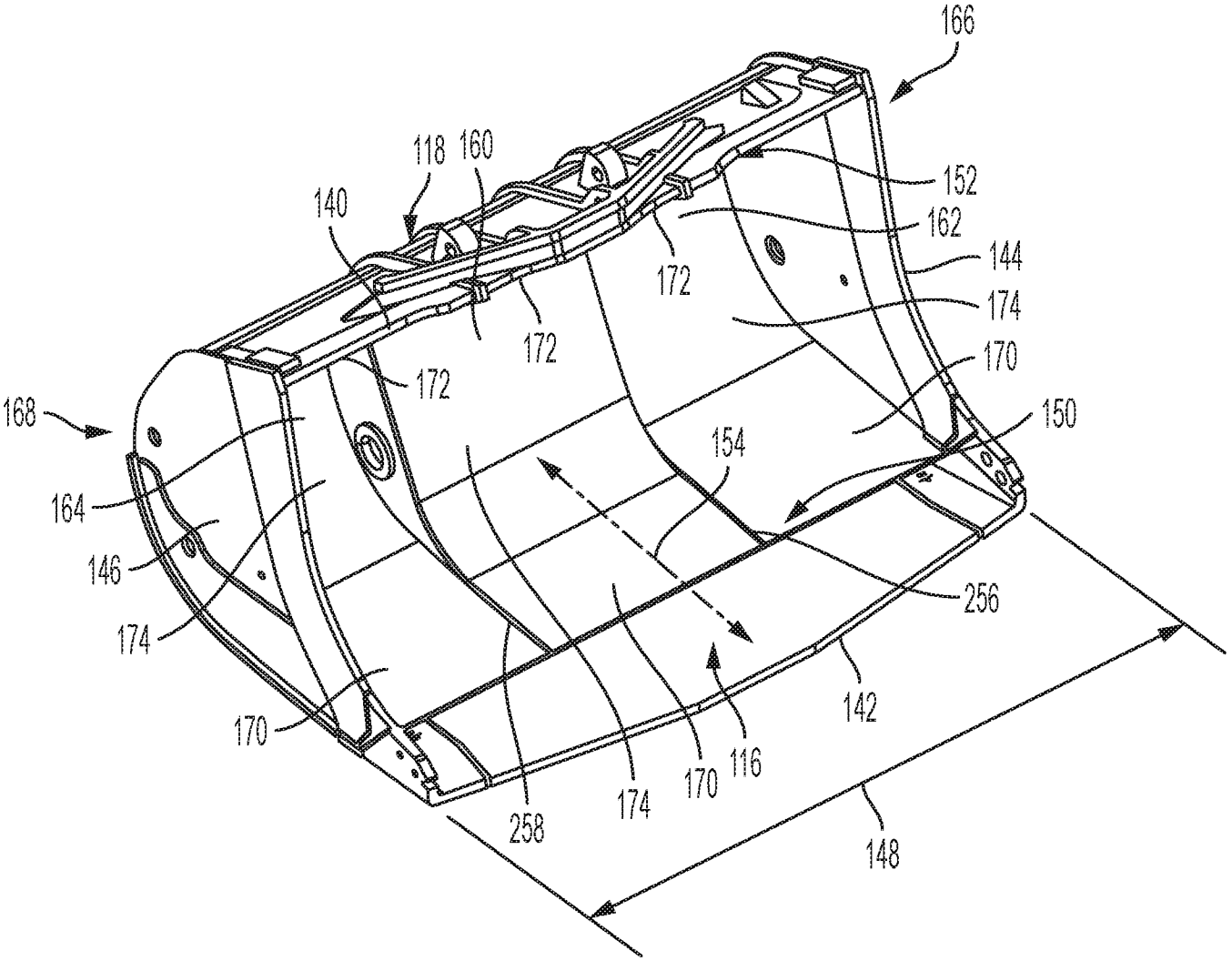
FIG. 3 is a front perspective view of the bucket assembled from a central shell and first and second outer shells flanking the central shell to provide a material-carrying volume.

Referring to FIG. 3, the opened bucket front 116 of the bucket 102 is an opened space to receive material and includes an upper lateral edge, referred to as a headboard 140, and a parallel, spaced apart lower lateral edge, that may be referred to as a cutting edge 142 because it cuts into and penetrates the material. In an embodiment, the cutting edge 142 can have a plurality of ground-engaging tools or teeth disposed there along. The headboard 140 and cutting edge 142 extend laterally between a first sidewall 144 and an opposite second sidewall 146. The first and second sidewalls 144, 146 can also be referred to as "left" and "right" sidewalls in relation to the viewpoint of the machine operator from the concaved bucket back 118 of the bucket 102. The distance between the first and second sidewalls 144, 146 defines the lateral dimension 148 (i.e. left to right) or length of the bucket 102. To conform to the shape of the concaved bucket back 118, the first and second sidewalls 144, 146 may be generally U-shaped and are directed rearward from the opened bucket front 116 toward the concaved bucket back 118 of the bucket 102. In addition, the bucket 102 can include a lowermost bucket floor 150 extending from the opened bucket front 116 to the concaved bucket back 118 and a spaced-apart bucket roof 152 likewise extending from the opened bucket front 116 to the concaved bucket back 118. The bucket floor 150 and the bucket roof 152 may be generally planar and may diverge from each other at a slight angle toward the opened bucket front 116. When the bucket 102 is disposed in the digging position, the bucket floor 150 with the attached cutting edge 142 can be adjacent the ground and the bucket roof 152 and the attached headboard 140 are located overhead. The continuous curve of the concaved bucket back 118 transitions between and interconnects the bucket floor 150 and bucket roof 152 such that the bucket 102 defines a trough-like, material receiving volume that can accommodate and hold the material of interest. The depth of the trough-like bucket 102 can be defined with respect to a bucket centerline 154 that is oriented normal to the lateral dimension 148 of the bucket 102 and that extends from the opened bucket front 116 to the concaved bucket back 118. The bucket centerline 154 may be generally centrally oriented mid-length between the first and second sidewalls 144, 146 and mid-height between the lower bucket floor 150 and the upper bucket roof 152.

In the illustrated embodiment, the bucket 102 can be assembled as a bucket shell assembly made from three subcomponents including a center shell 160, a first outer shell 162 flanking the center shell 160 to a first lateral side 166, and a second outer shell 164 flanking the center shell 160 to an opposite second lateral side 168. The center shell 160, first outer shell 162, and second outer shell 164 can be manufactured separately from cast or finished steel or other metal and can be joined in the lateral arrangement by, for example, welding. To join the first and second sidewalls 144, 146 to the first outer shell 162 and the second outer shell 164 respectively, the first and second sidewalls can also be made of steel or metal that can be joined by welding. Like the bucket 102, each of the center shell 160, first outer shell 162, and second outer shell 164 can have a planar shell floor 170, a planar shell roof 172, and a concaved shell back 174 curving between and interconnecting the planar shell floor and the planar shell roof. The shell floor 170 of the center shell 160 and the shell floor 170 of the flanking first and second outer shells 162, 164 can align in a common plane to form the planar bucket floor 150. Likewise, the shell roof 172 of the center shell 160 and the shell roof 172 the flanking first and second outer shells 162, 164 can align in a common plane to form the planar bucket roof 152. However, in an embodiment, the concave shell back 174 of the center shell 160 can be offset forwardly along the bucket centerline 154 toward the opened bucket front 116 with respect to the concaved shell backs 174 of the flanking first and second outer shells 162, 164. Accordingly, the center shell 160 appears to protrude into the trough-like volume defined by the bucket 102.

Figure 4:
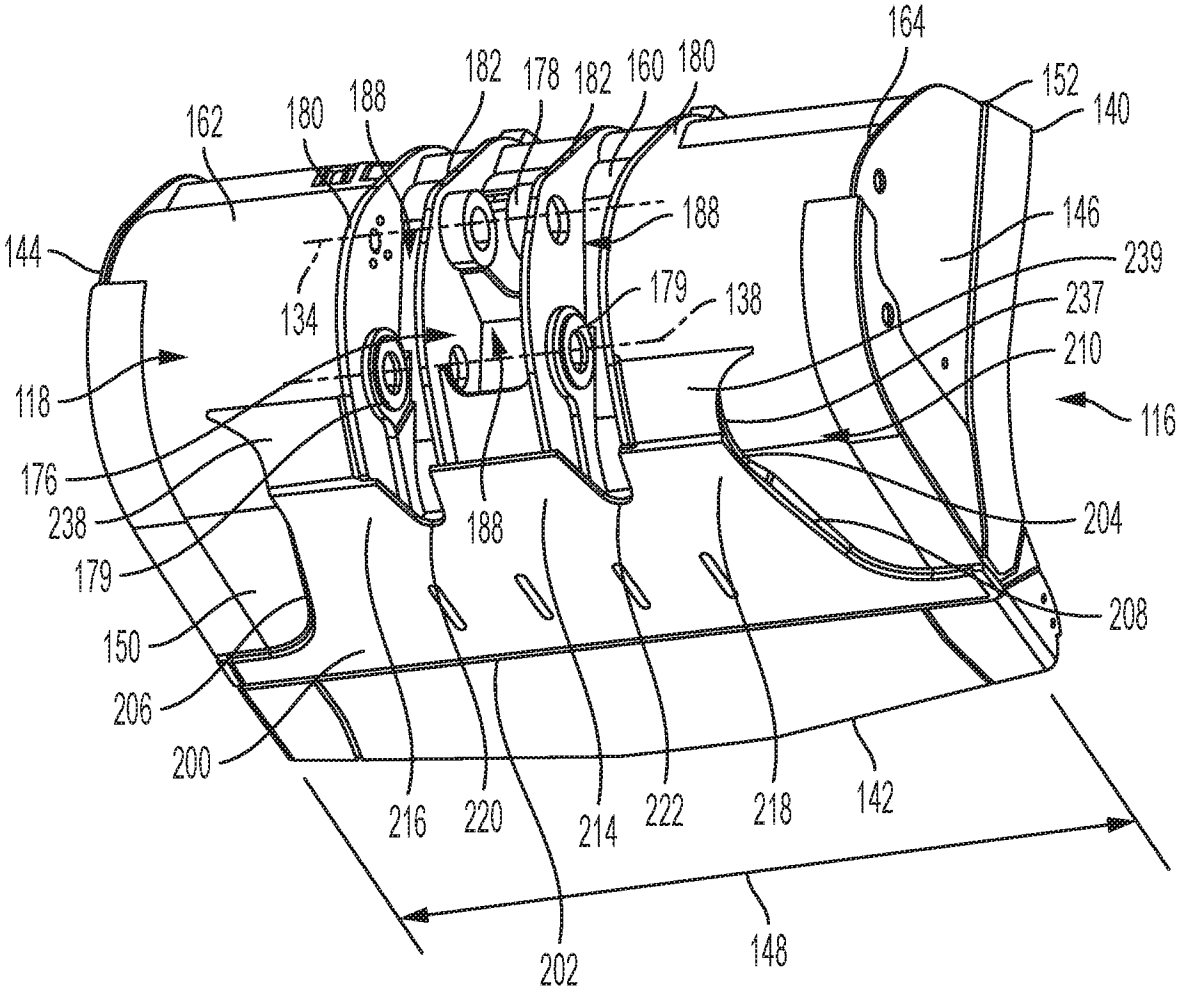
FIG. 4 is a rear perspective view of the bucket showing the lift arm slots disposed in an indentation in the concaved bucket back and the trumpet-shaped paddle plate attached underneath to stiffen the bucket.

Referring to FIG. 4, to couple the bucket 102 to the lift implement of the loading machine, the concaved bucket back 118 can include structures to cooperatively form the upper and lower coupling connectors described above. Moreover, to accommodate the coupling structures within the space constraints of the loading machine, an indentation 176 is provided in the concaved bucket back 118 by forwardly offsetting the center shell 160 of the bucket shell assembly with respect to the flanking first and second outer shells 162, 164. For example, the indentation 176 provides access into the volume of the bucket 102 in which the coupling structures can be accommodated while maintaining the bucket in close proximity adjacent to the front of the loading machine. Further in this regard, maintaining the flanking first and second outer shells 162, 164 rearward of the center shell 160 increases the material volume the bucket 102 can accommodate. The connector structures may include, for example, an upper fork 178 located in the indentation 176 that has two spaced-apart eyes aligned about the upper pivot axis 134. When the distal end of the connector link of the lift implement is disposed between the upper fork 178, it can be pivotally secured thereto by a pin inserted through the spaced-apart eyes to form the upper coupling connector. To form the lower coupling connector, the concaved bucket back 118 can include a first and second lower forks 179 located in the indentation 176 laterally flanking the upper fork 178 and disposed generally toward the bucket floor 150. The first and second lower forks 179 can also each have two spaced-apart eyes aligned with the lower pivot axis 138. The first and second lower forks 179 can pivotally connect via an inserted pin with the distal ends of the lift arms when disposed between the respective first and second lower forks.

To support and reinforce the coupling connections made between the upper and lower forks 178, 179 of the bucket 102 and the lift implement, a plurality of hinge plates can be assembled to the concaved bucket back 118 and disposed within the indentation 176. The hinge plates may include first and second outer hinge plates 180 that may be located at the joint or seam between the center shell 160 and the first outer shell 162 and between the center shell 160 and the second outer shell 164 respectively. Two inner hinge plates 182 can also be included that are located laterally between the first and second outer hinge plates 180 and joined directly to the concaved shell back of the center shell 160. Accordingly, a total of four outer and inner hinge plates 180, 182 are arranged vertically in the indentation 170 and can extend between the bucket floor 150 and the bucket roof 152 so as to be perpendicular to the lateral dimension 148 of the bucket 102, although in other embodiments, different numbers and arrangements of hinge plates may be used. The outer and inner hinge plates 180, 182 can be generally C-shaped to conform to the profile of the concaved bucket back 118 and can be made of metal to facilitate welding of the components into the indentation 170. The laterally spaced-apart arrangement of the four outer and inner hinge plates 180, 182 separates the indentation 176 in the concaved bucket back 118 into three parallel, laterally arranged connector slots 188. The upper fork 178 can be located in the middle connector slot 188 and the first and second lower forks 179 can be located in the two outer connector slots 188. The elongated connector slots 188 provide space to accommodate the distal ends of the connector link and lift arms from the lift implement and can align those components with the upper fork 176 and lower forks 179.

In use, the bucket underside 198, which may be the exterior surface of the bucket floor 150, contacts the ground and is forcibly moved there along to dig or penetrate into material, subjecting the bucket underside 198 to significant abrasive wear and imparted loads and stresses. Additionally, as the forwardly located cutting edge 142 is forcibly moved into the material, reactive loads and forces must be transferred rearward to the concaved bucket back 118 through the bucket floor 150. In the embodiment in which the center shell 160 is offset forwardly of the flanking first and second outer shells 162, 164, the offset geometry at those intersections may concentrate stresses and forces that can crack or cause failure of the joints or seams. Accordingly, to resist wear and strengthen the bucket floor 150 against such loads and forces, a wear plate may be joined to the bucket underside 198 to which a plurality of wear pads can be attached. The wear pads resist abrasive wear from the ground and the wear plate may strengthen the bucket underside 198 against forces imparted to the cutting edge 142. The wear plate, however, may add weight to the bucket 102 that must be offset by limiting the quantity of material that can be accommodated per load.

Figure 5:
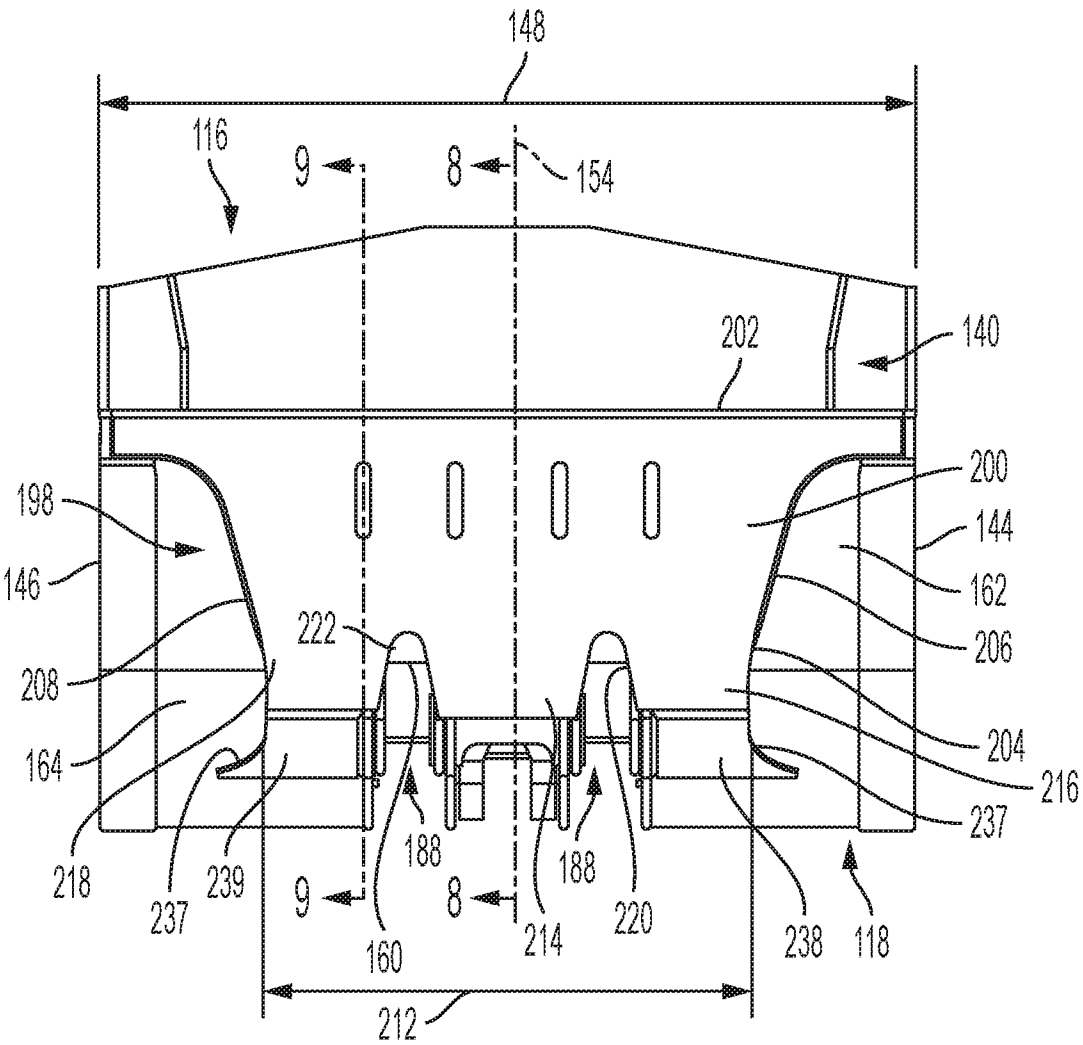
FIG. 5 is a bottom plan view of the bucket also showing the trumpet-shaped paddle plate attached to the bucket underside of the bucket floor.

Referring to FIG. 5 and in accordance with an aspect of the disclosure, a wear plate referred to herein as a paddle plate 200 can be joined to the bucket underside 198. The paddle plate 200 can be a flat planar plate made of metal that can be joined to the bucket underside 198 by, for example, welding. In an embodiment, the paddle plate 200 can have a horn-shape or trumpet-shape including a flared forward plate edge 202 that tapers toward a rearward plate tail 204. The flared forward plate edge 202 can be located behind and extends adjacent to the cutting edge 142 attached to the bucket floor 150. The flared forward plate edge 202 can be laterally coextensive with the lateral dimension 148 of the bucket 102 between the first and second sidewalls 144, 146. As the paddle plate 200 extends rearward with respect to the bucket centerline 154, the lateral extension of the paddle plate 200 tapers inwardly toward the bucket centerline to form a plate tail 204. For example, the paddle plate 200 can include a first arcuate edge 206 that is disposed toward the bucket centerline 154 inwardly from the first sidewall 144 and a second arcuate edge 208 that is disposed toward the bucket centerline 154 inwardly from the second sidewall 146. The converging first and second arcuate edges 206, 208 taper toward the rearward plate tail 204 that can be located proximate the lower segments of the concaved bucket back 118, which may be referred to as the heel 210 of the bucket 102.

In an embodiment, the plate tail 204 can have a lateral extension 212 sufficient to overlap the center shell 160 and portions of the flanking first and second outer shells 162, 164 while still being spaced toward the bucket centerline 154 inwardly from the first sidewall 144 and second sidewall 146. A possible advantage of tapering the paddle plate 200 to the plate tail 204 with the first and second converging arcuate edges 206, 208 is that the weight of the paddle plate may be reduced while the flared forward plate edge 202 is still laterally coextensive with the lateral dimension of the bucket 102. Accordingly, loads applied at any location laterally along the cutting edge 142 can be directed rearward to the flared forward plate edge 202, then directed centrally toward the bucket centerline 154, in accordance with the first and second arcuate edges 206, 208, as the paddle plate tapers to the rearward plate tail 204 where the load is transferred to the hinge plates 180, 182. Even if loads are applied to the corners of the bucket 102 (i.e., proximate the first and second sidewalls 144, 146), for example by striking a mine wall, the loads may be centrally directed to the hinge plates 180, 182 by the trumpet shape of the paddle plate 200. A possible related advantage of the trumpet shape is that the paddle plate 200 still provides significant coverage of the bucket underside 198 and reduce the weight stress imparted to the bucket underside. In addition, because the plate tail 204 may overlap the interfaces between the center shell 160 and the first and second outer shells 162, 164, the plate tail can protect the weld seams joining the components together proximate the bucket heel 210.

In a further embodiment, because the plate tail 204 may extend partially under the indentation 170 disposed in the concaved bucket back 118, the plate tail 204 proximate the bucket heel 210 can be configured as a forked plate tail. For example, the plate tail 204 can be separated into a center heel branch 214 and first and second outer heel branches 216, 218 that laterally flank the center heel branch 214. The lateral spacing of the center heel branch 214 and the first and second outer heel branches 216, 218 delineate a first lift arm notch 220 between the center branch and first outer heel branch and a second lift arm notch 222 between the center branch and second outer heel branch. The first and second lift arm notches 220, 222 can be generally parallel to the bucket centerline 154 and can align with the two outer connector slots 188 of the indentation 170 to provide clearances thereto. Accordingly, when the bucket 102 is tilted, the lift arms of the lift implement can be received into the first and second lift arm notches 220, 222 without damaging the plate tail 204. A further possible advantage of including the center heel branch 214 and the first and second outer heel branches 216, 218 at the bucket heel 210 is that additional wear pads can be attached thereto, providing additional abrasion resistance at the bucket heel 210 which may forcibly contact the ground 112 during tilting of the bucket 102.

Figure 6:
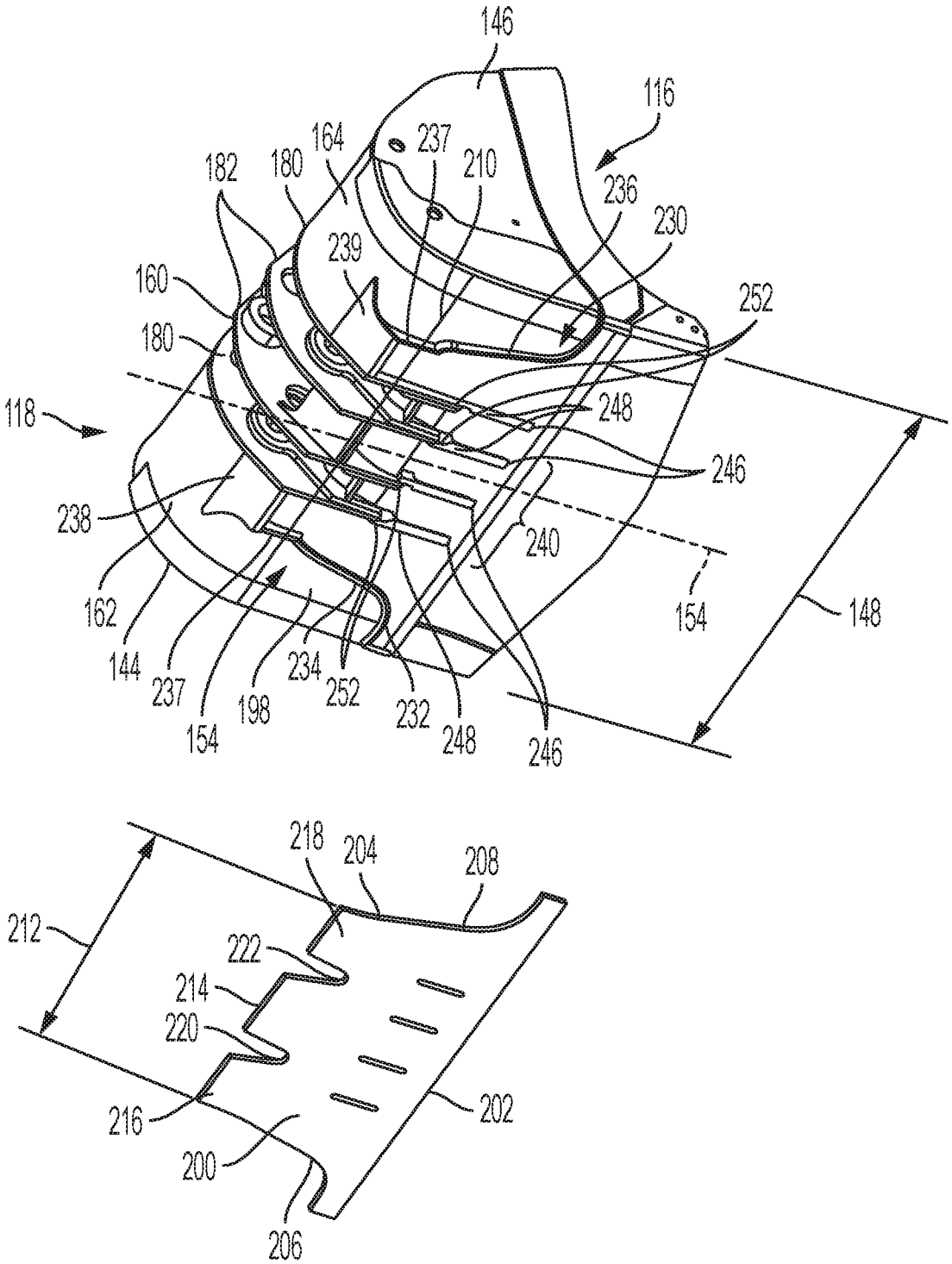
FIG. 6 is a rear assembly view of the bucket with the paddle plate removed and the seat frame projecting from a bucket underside of the bucket floor to outline and box the paddle plate.

Referring to FIG. 6, to rigidly secure the paddle plate 200 to the bucket underside 198 of the bucket floor 150, the bucket underside 198 can include a seat frame 230 that conforms in shape or outline to the paddle plate 200. The seat frame 230 can be formed by a raise or projecting ribbing 232 in the form of a short ridge that projects downwardly from the bucket underside 198 and which corresponds in coterminous shape with the trumpet-shaped outline of the paddle plate 200. For example, to match the outline of the paddle plate 200, the projecting ribbing 232 can include a first arcuate rib 234 that curves inwardly from the first sidewall 144 toward the bucket centerline 154 and a second arcuate rib 236 that curves inwardly from the second sidewall 146 toward the bucket centerline 154. The first and second arcuate ribs 234, 236 conform in shape, dimension, and orientation with the first and second arcuate edges 206, 208 of the paddle plate 200 and likewise cause the extension of the seat frame 230 to taper from being equal with lateral dimension 148 of the bucket 102 at the opened bucket front 116 to substantially narrower towards the concave bucket back 118.

In addition, the seat frame 230 can include a first backstay 238 and a second back stay 239 that are parallel to the lateral dimension 148 of the bucket 102 and that are located proximate the bucket heel 210. For example, the first and second backstays 238, 239 can project downwardly from the portions of the concaved bucket back 118 corresponding to the first and second outer shells 162, 164 and are adjacent the first and second outer hinge plates 180 respectively. The first and second backstays 238, 239 serve to interconnect the plate tail 204 and curved segment of the concaved bucket back 118 at the bucket heel 210 where they may be otherwise spaced apart. The backstays 238, 239 may extend laterally from the first and second outer hinge plates 180 toward the respective first and second side plates 144, 146 and may be laterally coextensive with the reduced lateral dimension 212 of the plate tail 210. The backstays 38, 239 can therefore transfer load from the plate tail 204 to the outer hinge plates 180. To enclose the space between the curved bucket back 118 and the plate tail 204 defined by the backstays, 238, 239, each backstay can be associated with a backstay side plate 237 that may be perpendicular to the lateral dimension and parallel to the bucket centerline 154. The backstay side plates 237 can be triangular in shape, are laterally offset from the outer hinge plates 180, and can be welded to and enclose the backstays 238, 239, the concaved bucket back 118, and the plate tail 204, thereby providing an enclosed space to increase stiffness and prevent debris from collecting on the bucket back. The backstay side plates 237 can complete the rearward extension between the first and second arcuate edges 234, 236 and the backstays 238, 239. In an embodiment, the first and second backstays 238, 239 can be disposed at a rearward angle with respect to the vertical as they extend between the plate tail 204 and the concaved bucket back 118 to provide a clearance and a turning radius for when the bucket 102 is tilted into the racked position. In particular, because the backstays 238, 239 are oriented on a rearward slanted angle between the plate tail 204 and the concaved bucket back 118, they will avoid interfering with the ground clearance, for example, as indicated by the lower dashed line in FIG. 1. When the bucket 102 is in the racked position, the backstays 238, 239 may be oriented toward the ground and may provide additional area to attach additional wear pads.

When the paddle plate 200 is joined to the bucket underside 198, for example, by welding, the outline of the paddle plate 200 may be coextensively set adjacently against the projecting ribbing 232 of the seat frame 230. The projecting ribbing 232 serves to position and box the paddle plate 200 with respect to the bucket underside 198 of the bucket floor 150. The paddle plate 200 provides a planar surface on the bucket underside 198 that can contact and physically engage the ground when digging or loading with material.

In an embodiment, the bucket 102 can be configured as a wedge bottomed bucket in which the bucket floor 150 slopes upward as it extends from the forward cutting edge 142 at the opened bucket front 116 toward the rearward concaved bucket back 118. In accordance with the assembly of a wedge bottomed bucket, the bucket floor 150 can include a plurality of spacer wedges 240 that can be laterally disposed along and disposed between the bucket underside 198 and the paddle plate 200. In the illustrated example, four spacer wedges 240 can be included between and in abutting contact with the bucket underside 198 and the paddle plate 200 as illustrated in order to space the two components apart. Including the spacer wedges 240 in the gap between the bucket underside 198 and the paddle plate 200 and generally normal to the planar extension of the bucket underside and paddle plate may increase the structural integrity of the bucket 102, including the weld seams between the center shell 160 and the flanking first and second outer shell 162, 164, and may better may accommodate imparted loads and forces applied to the concaved bucket back 118. For example, the spaced-apart spacer wedge 140 direct loads between the plane of the paddle plate 200 and the plane of the bucket underside 198, while the space created between the paddle plate and bucket underside reduces the mass of the bucket 102. In addition, sloping the bucket floor 150 upwards may assist in receiving material into the bucket 102.

Figure 7:
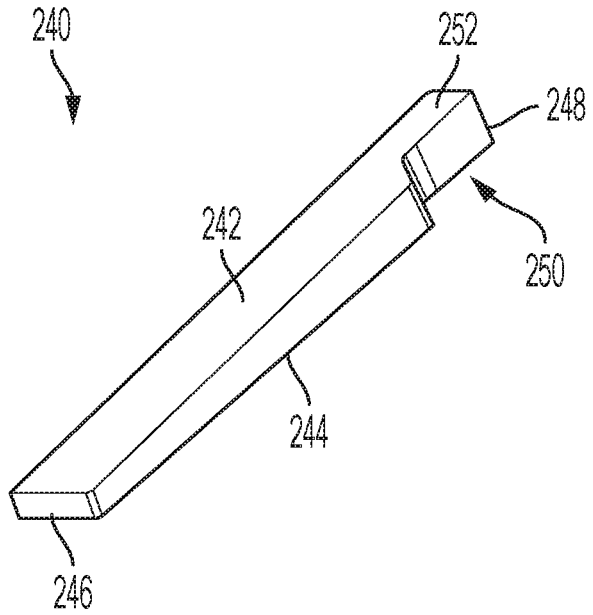
FIG. 7 is a perspective view of a spacer wedge that may be used to space apart the bucket underside and the paddle plate while bracing and supporting the hinge plates disposed in the bucket.

Referring to FIG. 7, the spacer wedges 240 can be shaped as an inclined plane including a first inclined surface 242 and a second inclined surface 244 that are arranged on a diverging angle with respect to each other. The first and second inclined surfaces 242, 244 can extend from a tapered end 246 to a broadened end 248 in accordance with the diverging angle. In addition, the broadened edge 248 can be formed with a side notch 250 disposed in a side of the spacer wedge 240 proximate the broadened end 248 so that a narrow wedge finger 252 extends along the opposite side of the spacer wedge. Accordingly, the spacer wedge 240 can be wider at the tapered end 246 than at the broadened end 248. To facilitate assembly by welding, the spacer wedge 240 can be manufactured from steel or another metal.

Referring to FIG. 6, when the spacer wedges 240 are included, they may be linearly aligned with the plurality of outer and inner hinge plates 180, 182 to brace the hinge plates. For example, the plurality of spacer wedges 240 can be attached to the bucket underside 198 so that the tapered end 246 is directed forwardly toward the opened bucket front 116 and the broadened end 248 is directed rearward toward the concaved bucket back 118 and the elongated extension of the spacer wedges 240 are parallel to the bucket centerline 154. Each spacer wedge 240 can be aligned with a respective one of the outer and inner hinge plates 180, 182 and the wedge fingers 252 can make sliding contact with one side surface of the respective hinge plate. The presence of the side notch in the spacer wedge 240 to create the wedge finger 252 that enables sliding contact with the respective one of the outer or inner hinge plates 180, 182. Sliding contact enables for slip fitting or a sliding fit of the spacer wedges 240 with the hinge plates 180, 182 so that the location of the spacer wedges can be shifted forwardly toward the opened bucket front 116 or rearward toward the concaved bucket back 118, which can accommodate tolerance stacking variations. In an embodiment, to improve the strength of the multi-component bucket 102, one spacer wedge 240 can be located to overlap a first weld seam 256 (see FIG. 3) at the interface between the center shell 160 and the first outer shell 162 and another spacer wedge 240 can be located to overlap a second weld seam 258 (see FIG. 3) at the interface between the center shell 160 and the second outer shell 164. Accordingly, when the center shell 160 and first and second outer shells 162, 164 are welded together, the spacer wedges 240 overlapping the weld seams 256, 258 strengthens the joint by fusing together with the shell components.

Figure 8:
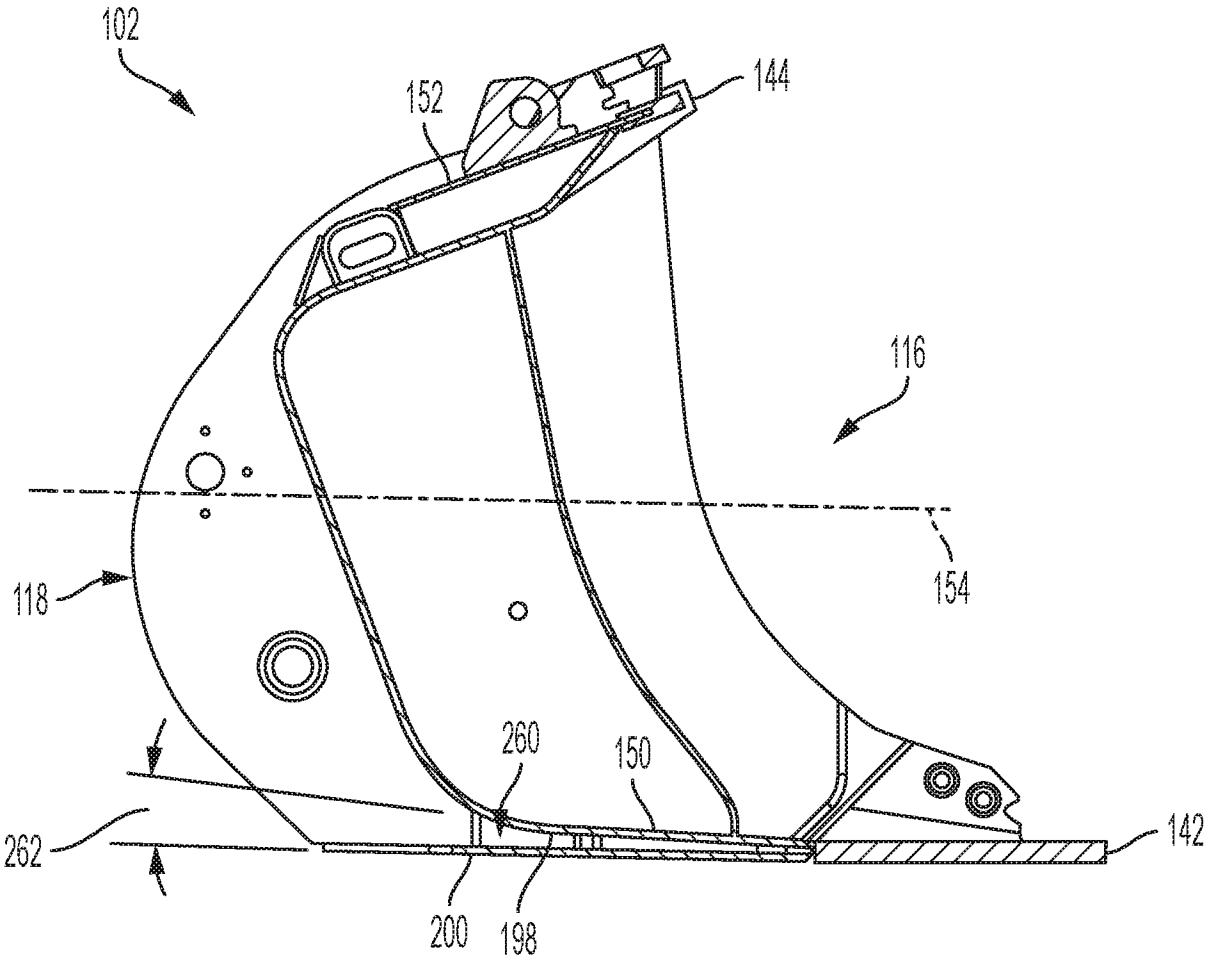
FIG. 8 is a cross-sectional view taken along line 8-8 of FIG. 5 showing the separation gap between the bucket floor and the paddle plate.
Figure 9:
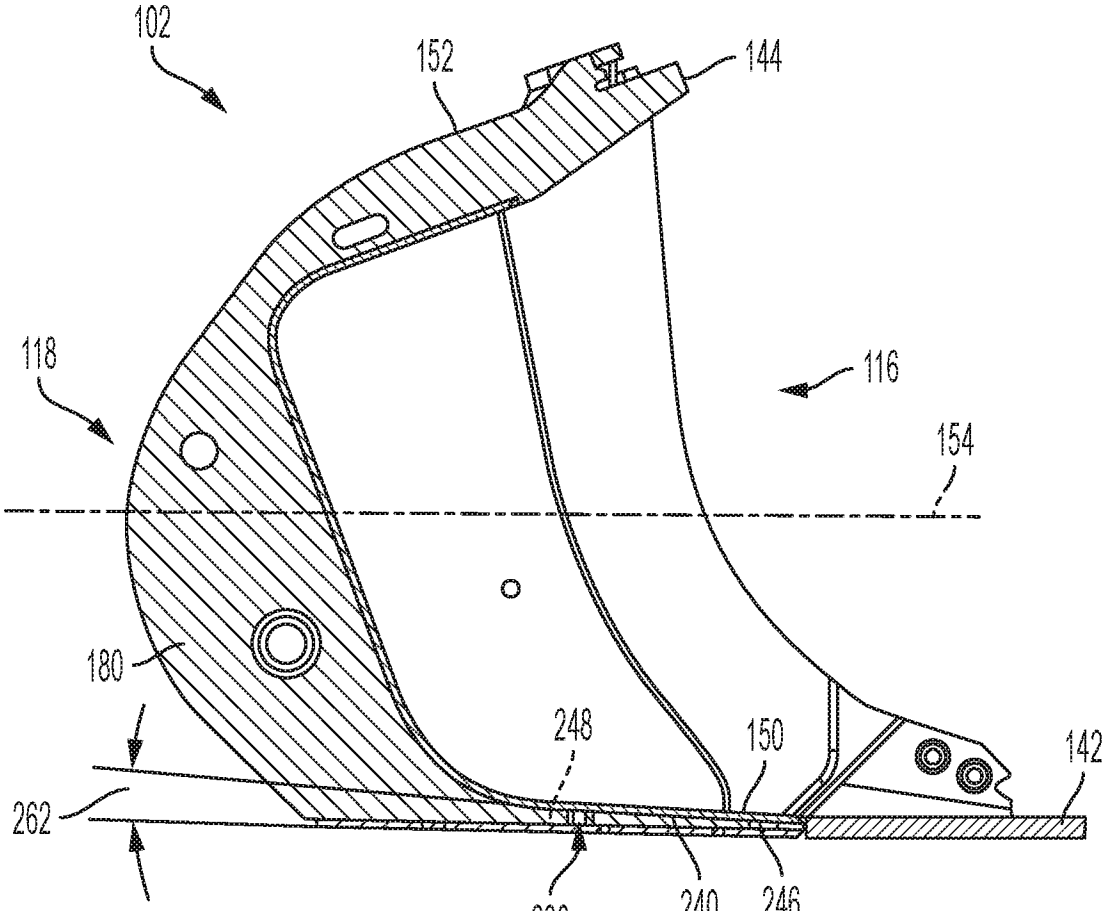
FIG. 9 is a cross-section view taken along line 9-9 of FIG. 5 showing the spacer wedge disposed between the bucket floor and the paddle plate and sliding adjacent the first hinge plate.

Referring to FIGS. 8 and 9, the spacer wedges 240 space apart and offset the paddle plate 200 with respect to the bucket underside 198 of the bucket floor 150 to create a separation gap 260 there between. The separation gap 260 enables the bucket floor 150 to slope upwards facilitating reception of material while maintaining the paddle plate 200 at a less upward angle with respect to the ground, thereby providing a wedge bottomed bucket. The plurality of spacer wedges 240 can prevent the separation gap 260 from collapsing and can reinforce the seat frame 230 formed on the bucket underside that outlines and boxes the paddle plate 200. The separation gap 260 may increase in vertical dimension as the bucket underside 198 and the paddle plate extend rearward such that the bucket underside and paddle plate are disposed at a diverging angle 262 with respect to each other. In an embodiment, the diverging angle 262 may be approximately 3-4 degrees. Offsetting the paddle plate 200 from the bucket underside 198 with the seat frame 230 and the spacer wedges 240 serves to reinforce the bucket floor 150 against bending and distortion under the loads applied when digging. In addition, inclusion of the separation gap 260 can function to reduce the weight of bucket 102 which may increase the quantity of material that can be lifted by the loading machine per cycle. Referring to FIG. 9, the spacer wedge 240 can linearly align with and make sliding contact with the hinge plate 180 so that loads and forces can be transferred from the bucket floor 150 to the hinge plate.

INDUSTRIAL APPLICABILITY

Referring generally to the drawings, in operation, the loading machine 100 can be used to dig or penetrate into a pile or wall of material thereby imparting loads and forces to the cutting edge 142 of the bucket 102. To transfer the loads to the lift implement 104 and onto the loading machine 100 in a manner that avoids distorting or applying uneven bending stresses to the bucket floor 150, a paddle plate 200 can be joined to and offset from the underside 198 of the bucket floor 150. When the cutting edge 142 contacts the material, the imparted loads can be transferred rearward to both the bucket floor 150 and the paddle plate 200 that are disposed on the diverging angle 262. Loads and forces may be further transferred from the bucket floor 150 and paddle plate 200 to the plurality of spaced-apart spacer wedges 240 that are linearly aligned with the plurality of outer and inner hinge plates 180, 182 that reinforce the structure of the bucket 102. Moreover, because the hinge plates 180, 182 are directly coupled to the lift implement, forces directed thereto can be accommodated and distributed. The foregoing design provides an improved load path through the bucket floor 150. Inclusion of the paddle plate 200 to the bucket underside 198 increase stiffness and resists bending loads and distortion of the bucket floor 150 while the trumpet-shape reduces weight of the bucket 102 overall while maintaining an effective load path between the cutting edge 142 and the hinge plates 180, 182 that connect with the lift implement 104.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A bucket for a loading machine comprising:

a bucket shell assembly including an opened bucket front and a concaved bucket back defining a bucket depth along a bucket centerline extending from the opened bucket front to the concaved bucket back;

the bucket shell assembly further including a center shell, a first outer shell flanking the center shell to a first lateral side, and a second outer shell flanking the center shell to a second lateral side with the center shell offset forwardly along the bucket centerline with respect to the first outer shell and the second outer shell;

the bucket shell assembly further including a first sidewall joined to the first outer shell and a second sidewall joined to the second outer shell, the first and second sidewalls defining a lateral dimension of the bucket shell assembly;

a first hinge plate between the center shell and the first outer shell and a second hinge plate between the center shell and the second outer shell;

a paddle plate joined to a bucket underside, the paddle plate having a trumpet-shape tapering from a flared forward edge extending the lateral dimension of the bucket to a plate tail disposed rearward toward the concaved bucket back; and a first backstay and a second backstay each extending on a rearward angle between the plate tail and the concaved bucket back, the first backstay laterally adjacent to the first hinge plate and the second backstay laterally adjacent to the second hinge plate; the first backstay and the second backstay each associated with a backstay side plate to provide an enclosed space between the paddle plate and the concaved bucket back.

2. The bucket of claim 1, wherein the paddle plate includes a first arcuate edge directed toward the bucket centerline and a second arcuate edge directed toward the bucket centerline.

3. The bucket of claim 2, wherein the bucket underside includes a seat frame including a projecting ribbing generally corresponding to the trumpet-shape.

4. The bucket of claim 3, wherein the projecting ribbing includes a first arcuate rib and a second arcuate rib.

5. The bucket of claim 1, wherein the bucket shell assembly includes a bucket floor and a bucket roof disposed above the bucket floor with the concaved bucket back interconnecting the bucket floor and the bucket roof.

6. The bucket of claim 5, wherein the bucket floor is a wedge bottomed bucket including a separation gap between the bucket underside and the paddle plate.

7. The bucket of claim 6, further comprising a plurality of spacer wedges located in the separation gap between the bucket underside and the paddle plate.

8. The bucket of claim 7, wherein the plurality of spacer wedges each include a first inclined surface adjacent to the bucket underside and a second inclined surface adjacent to the paddle plate.

9. The bucket of claim 8, wherein a first inclined wedge of the plurality of spacer wedges overlaps a first weld seam between the center shell and the first outer shell and a second inclined wedge overlaps a second weld seam between the center shell and the second outer shell.

10. The bucket of claim 1, wherein the concaved bucket back includes an indentation accommodating an upper coupling connector and a lower coupling connector.

11. The bucket of claim 10, wherein the concaved bucket back includes a plurality of hinge plates laterally spaced apart from each other and located at least partially in the indentation.

12. The bucket of claim 11, further comprising a plurality of spacer wedges located between the bucket underside and the paddle plate, each of the plurality of spacer wedges linearly aligned with a respective one of the plurality of hinge plates.

13. The bucket of claim 12, wherein each of the plurality of spacer wedges includes a side notch defining a wedge finger in sliding contact with a respective one of the plurality of hinge plates.

14. The bucket of claim 13, wherein the indentation is delineated by the center shell being forwardly offset with respect to the first outer shell and the second outer shell.

15. The bucket of claim 1, wherein the plate tail is forked and includes a center heel branch flanked by a first outer heel branch and by a second outer heel branch laterally spaced apart by a first lift arm notch and a second lift arm notch providing clearance for a lift implement.

16. The bucket of claim 1, wherein the backstay side plate associated with each of the first backstay and the second backstay is parallel to the bucket centerline.

17. A bucket for a loading machine comprising:

a bucket shell assembly including an opened bucket front and a concaved bucket back, the bucket shell assembly further including a bucket floor and a bucket roof with the concaved bucket back interconnecting the bucket floor and the bucket roof;

the bucket shell assembly further including a center shell, a first outer shell flanking the center shell to a first lateral side, and a second outer shell flanking the center shell to a second lateral side;

a paddle plate joined to a bucket underside of the bucket floor to provide a separation gap between the paddle plate and the bucket under side; and a plurality of spacer wedges disposed in the separation gap with a first spacer wedge of the plurality of spacer wedges overlapping a first weld seam between the center shell and the first outer shell and a second spacer wedge of the plurality of spacer wedges overlaps a second weld seam between the center shell and the second outer shell.

18. The bucket of claim 17, wherein the paddle plate has a trumpet-shape tapering from a flared forward edge extending across a lateral extension of the bucket to a plate tail disposed toward the concaved bucket back.

19. The bucket of claim 17, wherein the plurality of spacer wedges each includes a first inclined surface adjacent the bucket underside and a second including surface adjacent the paddle plate.

20. A bucket for a loading machine comprising:

a bucket shell assembly including an opened bucket front, a concaved bucket back, a bucket floor extending between the opened bucket front and the concaved bucket back, and a bucket roof extending between the opened bucket front and the concaved bucket back disposed above the bucket floor;

the bucket shell assembly further including a center shell, a first outer shell flanking the center shell to a first lateral side, and a second outer shell flanking to a second lateral side, wherein the center shell is offset toward the opened bucket front with respect to the first outer shell and the second outer shell;

a first hinge plate between the center shell and the first outer shell and a second hinge plate between the center shell and the second outer shell;

a paddle plate joined to a bucket underside of the bucket floor, the paddle plate having a trumpet-shape tapering from a flared front edge extending across a lateral extension of the bucket to a plate tail disposed rearward toward the concaved bucket back;

a first backstay and a second backstay extending at a rearward angle between the plate tail and the concaved bucket back, the first backstay laterally adjacent to the first hinge plate and the second backstay laterally adjacent to the second hinge plate; and a plurality of spacer wedges located between and spacing apart the bucket underside and the paddle plate.

21. The bucket of claim 20, wherein the first backstay and the second backstay are each associated with a backstay side plate to provide an enclosed space between the paddle plate and the concaved bucket back.

* * * * *